US009945380B2

(12) United States Patent
Schneider et al.

(10) Patent No.: US 9,945,380 B2
(45) Date of Patent: Apr. 17, 2018

(54) REFRIGERANT SCROLL COMPRESSOR FOR MOTOR VEHICLE AIR CONDITIONING SYSTEM INCLUDING AT LEAST ONE SEALING MEANS FOR BOTTOM SURFACE SEALING OF ORBITING SCROLL

(71) Applicant: Halla Visteon Climate Control Corp., Daejeon (KR)

(72) Inventors: Peter Schneider, Stolberg (DE); Bernd Guntermann, Lennestadt (DE); Thomas Klotten, Cologne (DE); Roman Heckt, Aachen (DE); Peter Michael Woelk, Cologne (DE)

(73) Assignee: HANON SYSTEMS, Daejeon-Si (KR)

( * ) Notice: Subject to any disclaimer, the term of this patent is extended or adjusted under 35 U.S.C. 154(b) by 0 days.

(21) Appl. No.: 14/753,065

(22) Filed: Jun. 29, 2015

(65) Prior Publication Data

US 2015/0308431 A1 Oct. 29, 2015

Related U.S. Application Data

(63) Continuation of application No. 13/890,575, filed on May 9, 2013, now abandoned.

(51) Int. Cl.

| | |
|---|---|
| ***F04C 27/00*** | (2006.01) |
| ***F04C 18/02*** | (2006.01) |
| ***F04C 29/02*** | (2006.01) |

(52) U.S. Cl.

CPC ..... *F04C 27/003* (2013.01); *F04C 18/0215* (2013.01); *F04C 18/0261* (2013.01); (Continued)

(58) Field of Classification Search

CPC ..... F04C 18/0215; F04C 18/0261; F04C 27/002; F04C 27/003; F04C 27/005; F04C 29/026

(Continued)

(56) References Cited

U.S. PATENT DOCUMENTS 4,502,852 A * 3/1985 Hazaki ..... F01C 21/04 418/55.6

5,110,268 A 5/1992 Sakurai et al.

(Continued)

FOREIGN PATENT DOCUMENTS

DE 69532902 T2 4/2005
DE 102005001160 A1 9/2005

(Continued)

OTHER PUBLICATIONS

English Machine Translation of JP 2004-124906A.*

*Primary Examiner* — Mark Laurenzi
*Assistant Examiner* — Paul Thiede
(74) *Attorney, Agent, or Firm* — Shumaker, Loop & Kendrick, LLP; James D. Miller

(57) ABSTRACT

A refrigerant scroll compressor for a motor vehicle air conditioning system having a fixed scroll, a orbiting scroll engaging with the fixed scroll, wherein the fixed scroll and the orbiting scroll cooperate to compress a refrigerant gas. An intermediate pressure chamber is disposed adjacent the orbiting scroll, an oil return duct provides fluid communication between the intermediate pressure chamber and a high pressure area of the refrigerant scroll compressor, and at least one intermediate pressure duct is formed in one of the orbiting scroll and fixed scroll and is in fluid communication with the intermediate pressure chamber.

14 Claims, 3 Drawing Sheets

(52) U.S. Cl.
CPC ..... *F04C 27/002* (2013.01); *F04C 27/005* (2013.01); *F04C 29/026* (2013.01)

(58) Field of Classification Search
USPC ..... 418/55.1, 55.5; 62/647
See application file for complete search history.

(56) References Cited

U.S. PATENT DOCUMENTS

| | | | | |
|---|---|---|---|---|
| 5,277,563 | A * | 1/1994 | Wen-Jen | F04C 29/0021 418/55.5 |
| 5,660,539 | A * | 8/1997 | Matsunaga | F04C 27/005 184/6.18 |
| 6,309,196 | B1 | 10/2001 | Jones et al. | |
| 6,896,497 | B2 | 5/2005 | Kuo | |
| 2006/0213218 | A1* | 9/2006 | Uno | F01C 11/004 62/467 |
| 2006/0263225 | A1* | 11/2006 | Ueda | F04C 27/005 418/55.5 |
| 2009/0191081 | A1 | 7/2009 | Lee et al. | |
| 2010/0158732 | A1 | 6/2010 | Sato et al. | |
| 2010/0212352 | A1 | 8/2010 | Kim et al. | |
| 2012/0237381 | A1* | 9/2012 | Murakami | F01C 21/10 418/55.1 |

FOREIGN PATENT DOCUMENTS

| | | | | |
|---|---|---|---|---|
| DE | 602004009026 | T2 | 6/2008 | |
| EP | 0348601 | A2 * | 1/1990 | F04C 18/0215 |
| EP | 1936196 | A2 | 6/2008 | |
| EP | 2369182 | A1 | 9/2011 | |
| JP | H02130284 | A | 5/1990 | |
| JP | 8-284835 | A | 10/1996 | |
| JP | 10-73085 | A | 3/1998 | |
| JP | 2004124906 | A * | 4/2004 | |
| JP | 2006300076 | A | 11/2006 | |
| JP | 2007-247614 | A | 9/2007 | |
| JP | 2010096040 | A | 4/2010 | |

* cited by examiner

REFRIGERANT SCROLL COMPRESSOR FOR MOTOR VEHICLE AIR CONDITIONING SYSTEM INCLUDING AT LEAST ONE SEALING MEANS FOR BOTTOM SURFACE SEALING OF ORBITING SCROLL

CROSS-REFERENCE TO RELATED APPLICATION

This application is a continuation patent application of U.S. patent application Ser. No. 13/890,575, filed May 9, 2013, the entire disclosure of which is hereby incorporated by reference.

FIELD OF THE INVENTION

The invention relates to a refrigerant scroll compressor for vehicle air-conditioning systems and in this context particularly a design with efficient oil recirculation within the refrigerant circuit while controlling the intermediate pressure level optimally.

BACKGROUND OF THE INVENTION

The use of refrigerant scroll compressors in motor vehicle air-conditioning systems is highly desirable, since this type of compressor has a robust structural design and can also be produced and used cost-effectively. Scroll compressors moreover operate radially to the inside, which results in a relatively short axial installation length for the compressor. An electrical refrigerant compressor can thus be designed without requiring any additional installation space compared to a mechanical refrigerant compressor.

The principle of compression of a scroll compressor consists of the fact that a orbiting scroll is moved in an oscillating manner within a fixed scroll such that a space forms between the flanks of the spirals, which becomes smaller from the external radial perimeter towards the center and therefore compresses the refrigerant gas that was collected at the periphery. The final compression pressure is obtained in an axial area of the spirals and the refrigerant gas is axially discharged at high pressure. For this purpose it is important that the orbiting scroll and the fixed scroll are sealed on their axial sides which lie one on top of the other, in order to prevent a radial cross flow of the refrigerant gas to the extent possible. For this reason, refrigerant scroll compressor design principles are used, which, by forming an intermediate pressure chamber, make it possible for the refrigerant gas to act on the orbiting scroll, so that a resulting force in the axial direction is created, whereby the orbiting scroll is pushed against the fixed scroll and thus seals the scrolls against one another.

A known problem with refrigerant scroll compressors consists of the fact that the oil return must be designed for process safety and at the same time must be able to develop a sufficient sealing force with reference to the orbiting scroll by controlling the intermediate pressure.

A scroll compressor with improved oil circulation and intermediate pressure control is known from U.S. Pat. Appl. Pub. No. 2009/0191081 A1. In this context, a scroll compressor is disclosed which realizes an oil return via the intermediate pressure chamber towards the suction side of the compressor.

This design from the prior art has the disadvantage, however, that the oil return and the intermediate pressure can only be poorly controlled.

SUMMARY OF THE INVENTION

The purpose of the invention consists in providing a refrigerant scroll compressor for motor vehicle air-conditioning systems which ensures a stable oil return and where the sealing force for sealing the fixed scroll to the orbiting scroll can moreover be well controlled.

This object is solved in particular by a refrigerant scroll compressor for motor vehicle air-conditioning systems, which comprises a fixed scroll and an orbiting scroll which rotates in an oscillating manner relative to same and which furthermore has an intermediate pressure chamber for generating the axial force for reciprocally sealing the scrolls. The refrigerant scroll compressor is characterized in that an oil return from the high-pressure line of the refrigerant circuit to the suction chamber of the refrigerant scroll compressor is formed. In addition, an intermediate pressure duct is arranged by means of which refrigerant gas from the compression process between the scrolls reaches the intermediate pressure chamber directly. The intermediate pressure chamber is therefore directly supplied with the refrigerant gas in the compression chamber which forms between the scrolls, wherein the pressure in the intermediate pressure chamber occurs as an intermediate pressure in the respective areas of the compression chambers of the scrolls, since the pressure in the compression chamber between the scrolls in principle changes depending on the reciprocal relative movement of the scrolls. This therefore covers an intermediate pressure range, from which refrigerant gas flows into the intermediate pressure chamber and a resulting intermediate pressure occurs in the intermediate pressure chamber.

An advantageous embodiment of the invention consists in that the oil return from the high-pressure line of the refrigerant circuit is formed by means of the oil return duct to the intermediate pressure chamber and the oil extraction duct is formed from the intermediate pressure chamber to the suction chamber of the refrigerant scroll compressor. The refrigerant gas stream which flows directly from the compression chamber between the scrolls into the intermediate pressure chamber mixes with the refrigerant oil in the intermediate pressure chamber with a resulting intermediate pressure, after which the refrigerant/oil mixture flows via the oil extraction duct to the suction chamber.

According to another embodiment of the invention, the intermediate pressure duct is arranged in the orbiting scroll and is furthermore preferably formed on the bottom of the orbiting scroll. It has been shown that the intermediate pressure duct can be designed particularly cost-effectively as an intermediate pressure bore.

As an alternative to forming the intermediate pressure duct in the orbiting scroll, the intermediate pressure duct can also be arranged in the fixed scroll, wherein the intermediate pressure duct must then be led around the orbiting scroll to the intermediate pressure chamber. In another embodiment, the intermediate pressure duct is arranged in the scroll such that the intermediate pressure duct is briefly within the high-pressure range during the compression. This means that the resulting intermediate pressure is determined essentially by the existing suction pressure, but also by the existing high pressure. Since the surface which is subjected to the high pressure is essentially on the inside of the scroll and therefore is smaller, this is accordingly reflected thereby. As a result, an intermediate pressure results in the intermediate pressure chamber on average.

According to a further embodiment, a first expansion device is arranged in the oil return duct and a second expansion device for restricting the oil from high pressure to the suction pressure is located in the oil extraction duct. The ratio of the cross-sections from the intermediate pressure duct to the first expansion device within the oil return duct to the intermediate pressure chamber is particularly preferable between 5 and 20. Favorable results have been obtained where the ratio of the cross-sections from the intermediate pressure duct to the first expansion device is 10.

The relatively large flow area for the refrigerant gas compared to the flow area for the oil return results in that the resulting sealing force can be well controlled, and therefore it essentially operates independently of the oil return.

A further advantageous embodiment of the invention is realized in that an intermediate pressure duct is formed in each of the chambers of the scroll compressor in areas which have the same functions at the same pressure level. This will increase the functional reliability of the compressor, since if an intermediate pressure duct fails due to plugging or the like, the lubrication still continues through the second duct. During normal operation without interference, the same lubricating characteristics are obtained for both scrolls. Viewed overall, this therefore improves the redundancy of lubricating the scrolls.

By using the conceptual implementation of the invention, the disadvantage of the prior art of the inaccurate and complicated control and management of the intermediate pressure by a mixture of refrigerant oil and refrigerant gas by means of the oil return can be overcome effectively in terms of design by providing the intermediate pressure duct. Refrigerant gas flows almost exclusively through the intermediate pressure duct, and it is thus possible to obtain a stable intermediate pressure in the intermediate pressure chamber.

Various advantages result from the implementation of the principle according to the invention of separating the oil return and the production of intermediate pressure by the separate feed of refrigerant gas to the intermediate pressure chamber. It should in particular be mentioned that a constant oil return flow can be guaranteed, independently of and/or less conditionally upon the intermediate pressure.

Another embodiment is that the intermediate pressure for generating the axial sealing force between the orbiting and the fixed scroll can be well controlled and managed. The higher intermediate pressure ensures a stable sealing function during the compression of the refrigerant gas between the scrolls.

BRIEF DESCRIPTION OF THE DRAWINGS

Further particulars, features and advantages of the embodiments of the invention result from the subsequent description of embodiments with reference to the associated drawings. The drawings show.

DETAILED DESCRIPTION OF EXEMPLARY EMBODIMENTS OF THE INVENTION

The following detailed description and appended drawings describe and illustrate various exemplary embodiments of the invention. The description and drawings serve to enable one skilled in the art to make and use the invention, and are not intended to limit the scope of the invention in any manner.

Figure 1:
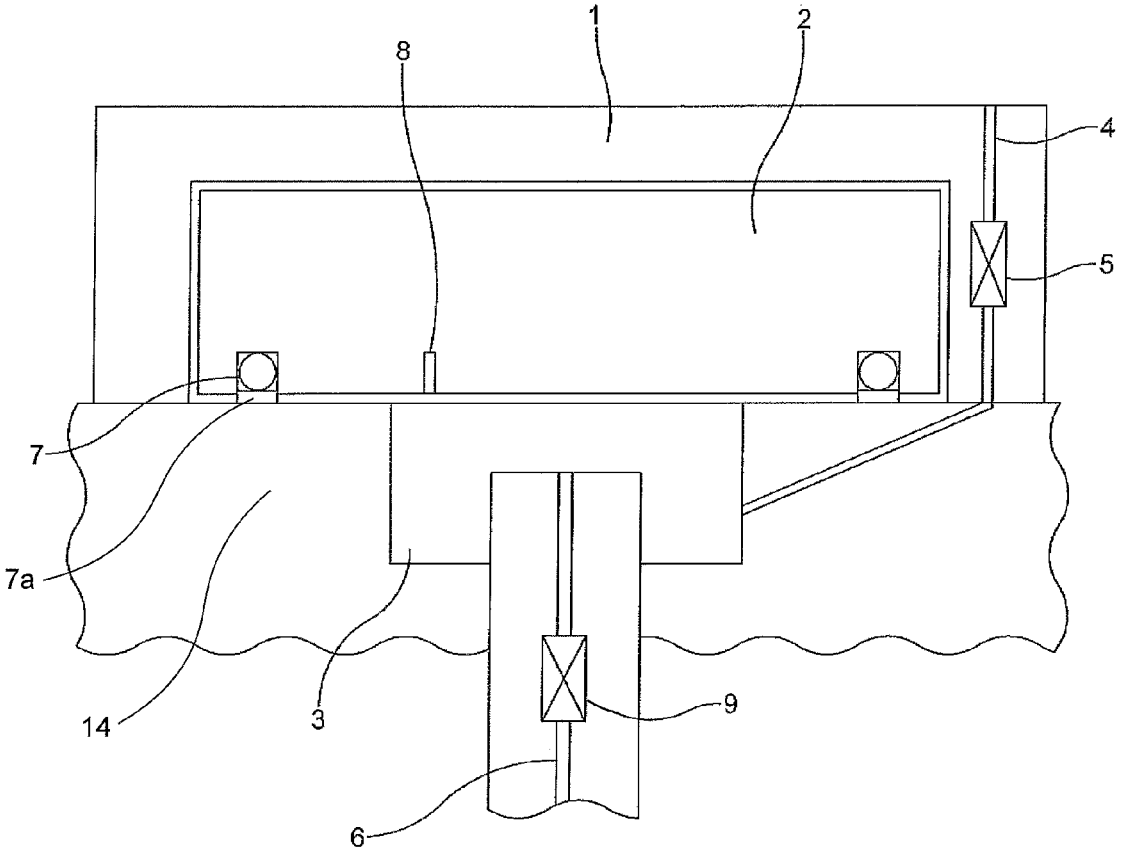
FIG. 1 is a schematic cross-section of a refrigerant scroll compressor.

FIG. 1 shows a highly schematic cross-section of a refrigerant scroll compressor. For this purpose, and according to the functional principle, an orbiting scroll 2 is located in a fixed scroll 1. The orbiting scroll 2 moves in an oscillating manner in the fixed scroll 1 such that between the scrolls 1, 2, cavities are formed which decrease radially from the outside to the inside, in which the refrigerant gas is compressed from the outside to the inside and the compressed refrigerant gas inside is finally discharged axially into the high-pressure chamber. FIG. 1 illustrates an intermediate pressure chamber 3 below the scrolls 1, 2, in which the refrigerant gas exists at an intermediate pressure. The resulting intermediate pressure in the intermediate pressure chamber 3 acts on the orbiting scroll 2 and is constituted such that a resulting axial force results from the forces which act from the intermediate pressure chamber 3 on the orbiting scroll 2 and the opposite forces between the orbiting scroll 2 and the fixed scroll 1 act oppositely. In the representation according to FIG. 1, the orbiting scroll 2 is pressed by the resulting axial force from the bottom against the fixed scroll 1. The orbiting scroll 2 on the side of the intermediate pressure chamber 3 is sealed with respect to a stationary housing 14 by an O-ring 7.

In the fixed scroll 1 and in the housing, which is not described in further detail, an oil return duct 4 is realized, by means of which the oil enters at a reduced flow into the intermediate pressure chamber 3 from the high-pressure area of the refrigerant circuit in a first expansion device 5. The oil from the intermediate pressure chamber 3 reaches the suction side, and/or the suction chamber of the compressor, via an oil extraction duct 6 with a second expansion device 9. The orbiting scroll 2 is supported and sealed by means of a gasket 7*a* and the O-ring 7 on its side facing the housing.

Decisive for the functionality according to the invention is that an additional intermediate pressure duct 8 be provided, which results in that the refrigerant gas arrives directly at the intermediate pressure chamber 3 through the cavities which form between the scrolls, and that an intermediate pressure results. In the illustrated embodiment pursuant to FIG. 1, the intermediate pressure duct 8 is designed for penetrating the bottom of the orbiting scroll 2 as a bore, which directly connects an inner area between the scrolls 1, 2 with the intermediate pressure chamber 3.

The schematically illustrated expansion devices 5, 9 are preferably cost-effectively designed as orifice plates. The principle according to the invention of separating the oil flow from the flow of the refrigerant gas within the compression process can be realized with the illustrated embodiment. The oil return duct 4 and the oil extraction duct 6 therefore function only for recirculating the oil, whereas the refrigerant gas enters the intermediate pressure chamber 3 by means of the intermediate pressure duct 8 to generate the axial sealing pressure. By decoupling the oil return and the gas flow for the intermediate pressure chamber 3, the process can be controlled much more effectively.

Figure 2:
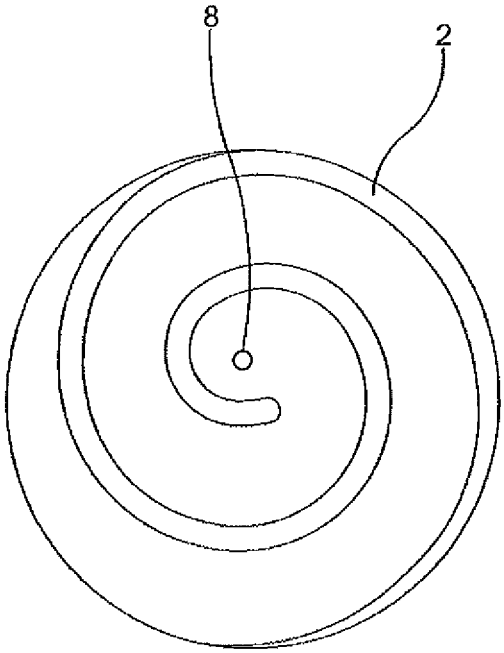
FIG. 2 is a plan view of an orbiting scroll with an intermediate pressure duct.

FIG. 2 illustrates an orbiting scroll 2 and an intermediate pressure duct 8 indicated in the bottom of the scroll as an intermediate pressure bore. Intermediate pressures with a pressure ratio of 3:15 of low pressure to high-pressure and of 5.9 to 7.6 bar can be achieved with the modified refrigerant scroll compressor. At a pressure ratio of 3:25 bar, the intermediate pressure will rise from 6.8 up to 8.6 bar, depending on how the intermediate pressure duct 8 is positioned, and on the rotational speed.

In some embodiments, the intermediate pressure duct 8 has a cross-section that is 10 times larger than the first expansion device 5. In this manner, the pressure in the intermediate pressure chamber 3 can be superbly controlled by the refrigerant gas. The closer that the intermediate pressure duct 8 is formed to the inner area of the scroll, the greater is the influence at different final compression pressures.

The pressure differential between high pressure outlet and intermediate pressure results in delivering the oil through the first expansion device 5 into the intermediate pressure chamber 3, which is filled as a result thereof. The pressure differential between the intermediate pressure chamber 3 and the suction area of the refrigerant compressor delivers the oil through the oil extraction duct 6 and through the second expansion device 9. Any oil that remains in the intermediate pressure chamber 3 flows back through the intermediate pressure duct 8 into the scroll package 1, 2 to provide same with lubrication.

Figure 3:
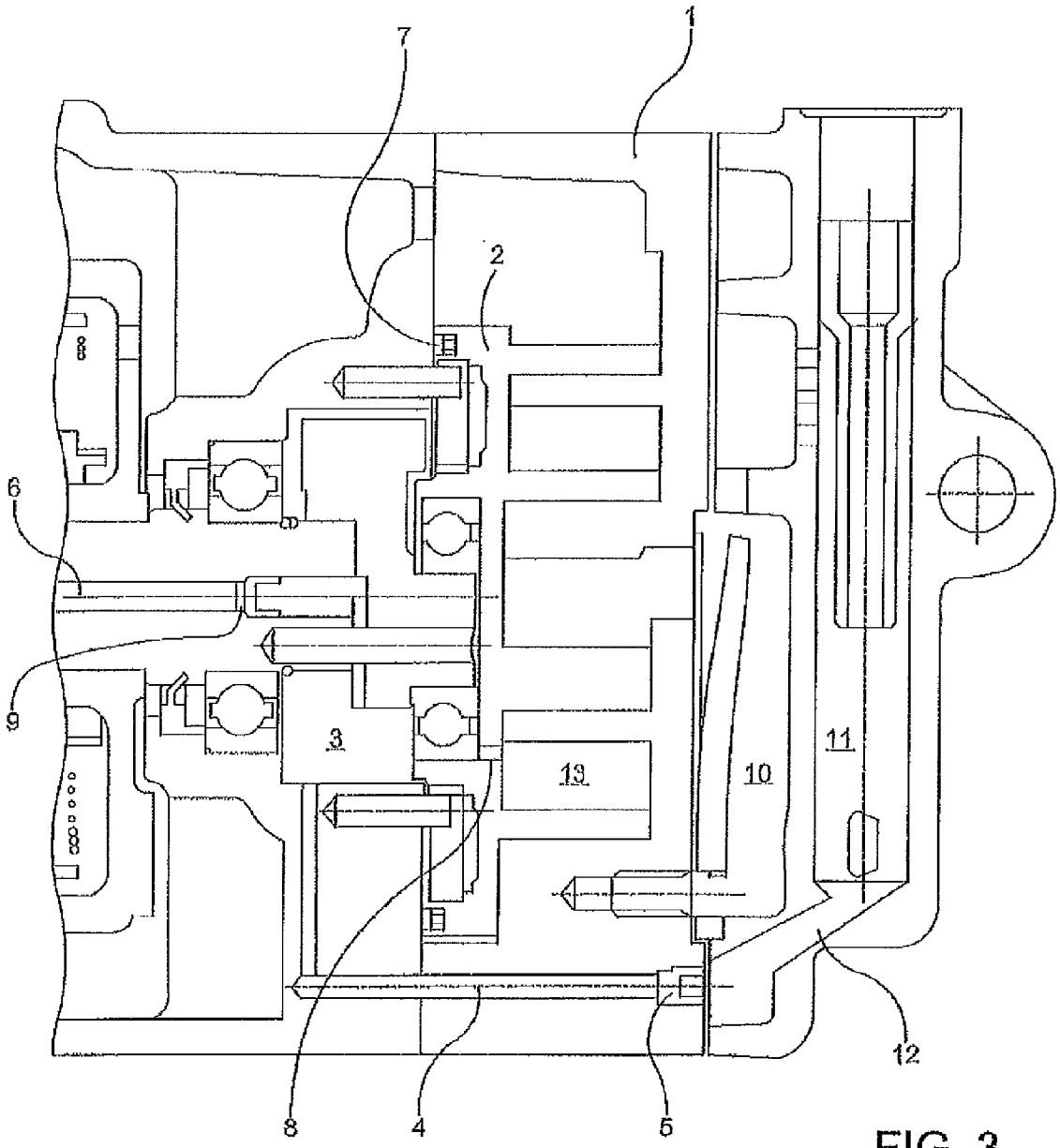
FIG. 3 is an embodiment of a refrigerant scroll compressor as a cross-section in a lateral view.

FIG. 3 illustrates the structural design of the refrigerant scroll compressor a little better than a mere schematic. The refrigerant/oil mixture from the high-pressure chamber 10 of the refrigerant scroll compressor is separated in the oil separator 11, and the liquid oil flows into the oil return duct 4 by means of a connection pipe 12. A first expansion device 5, designed as a restriction orifice, is arranged upstream of the oil entry into the oil return duct 4. This decompresses the refrigerant oil and it enters the intermediate pressure chamber 3.

Refrigerant gas from the compression process, passing from the compression chamber 13 formed between the fixed scroll 1 and the orbiting scroll 2, enters via the intermediate pressure duct 8 into the intermediate pressure chamber 3 parallel to the oil flow from the high-pressure chamber 10 of the refrigerant scroll compressor. An intermediate pressure of the refrigerant gas/oil mixture results in the intermediate pressure chamber 3.

In certain operational situations, a desirable return flow of the refrigerant oil from the intermediate pressure chamber 3 into the compression chamber 13 occurs, as a result of which improved lubrication of the scrolls 1, 2 is achieved.

The refrigerant gas/oil mixture exits the intermediate pressure chamber 3 via the second expansion device 9, which is again designed as a restriction orifice in the embodiment, and is discharged via the oil extraction duct 6.

An alternative embodiment that is not illustrated consists in that the oil return duct 4 is directed without a connection to the intermediate pressure chamber 3 directly towards the suction side of the compressor.

This form of design compared to designs from the prior art moreover results in a reduced number of components, and it is also possible to use standard components cost-effectively.

From the foregoing description, one ordinarily skilled in the art can easily ascertain the essential characteristics of this invention and, without departing from the spirit and scope thereof, can make various changes and modifications to the invention to adapt it to various usages and conditions.

LIST OF REFERENCE SYMBOLS

1 Fixed scroll
2 Orbiting scroll
3 Intermediate pressure chamber
4 Oil return duct
5 First expansion device, restriction orifice
6 Oil extraction duct
7 O-ring
7*a* Gasket
8 Intermediate pressure duct
9 Second expansion device, restriction orifice
10 High-pressure chamber
11 Oil separator
12 Connection line
13 Compression chamber
14 Stationary housing

What is claimed is:

1. A scroll compressor for a motor vehicle air conditioning system comprising:

a stationary housing including an outer surface;

a fixed scroll overlying and having engaging contact with the stationary housing;

an orbiting scroll engaging the fixed scroll and including an outer surface defining an annularly extending groove formed therein, wherein the fixed scroll and the orbiting scroll cooperate to compress a refrigerant gas;

an intermediate pressure chamber disposed adjacent the orbiting scroll;

at least one sealing means to seal the orbiting scroll including an annularly extending gasket and an annularly extending O-ring overlying the annularly extending gasket and having engaging contact therewith, the at least one sealing means extending from the outer surface of the stationary housing to the orbiting scroll wherein the annularly extending gasket is positioned adjacent the stationary housing and has engaging contact therewith and an entirety of the annularly extending O-ring is disposed in the annularly extending groove of the orbiting scroll; and at least one intermediate pressure duct formed in the orbiting scroll, the intermediate pressure duct being in fluid communication with the intermediate pressure chamber.

2. The scroll compressor of claim 1, wherein the annularly extending O-ring contacts at least one inner face of the orbiting scroll located within and adjacent the groove.

3. The scroll compressor of claim 1, wherein a cross-section of the annularly extending gasket taken through a plane parallel to a longitudinal axis of the scroll compressor is rectangular in shape.

4. The scroll compressor of claim 1, wherein a cross-section of the annularly extending O-ring taken through a plane parallel to a longitudinal axis of the scroll compressor is circular in shape.

5. The scroll compressor of claim 1, wherein the sealing means encircles the at least one intermediate pressure duct.

6. A scroll compressor for a motor vehicle air conditioning system comprising:

a stationary housing including an outer surface;

a fixed scroll overlying and having engaging contact with the stationary housing;

an orbiting scroll orbiting with respect to the fixed scroll, the fixed scroll and the orbiting scroll cooperating to compress a gas and the orbiting scroll including an outer surface facing the outer surface of the stationary housing, the outer surface of the orbiting scroll defining an annularly extending groove formed therein;

an intermediate pressure chamber defined by the stationary housing adjacent the orbiting scroll; and at least one sealing means extending from the outer surface of the stationary housing to the outer surface of the orbiting scroll, at least a portion of the at least one sealing means disposed in the annularly extending groove, the at least one sealing means including an annularly extending gasket and an annularly extending O-ring overlying the annularly extending gasket and having engaging contact therewith wherein the annularly extending gasket is positioned adjacent the stationary housing and has engaging contact therewith, wherein an entirety of the annularly extending O-ring is disposed in the annularly extending groove.

7. The scroll compressor of claim 6, wherein the annularly extending O-ring contacts at least one inner face of the orbiting scroll located within and adjacent the annularly extending groove.

8. The scroll compressor of claim 6, wherein a cross-section of the annularly extending gasket taken through a plane parallel to a longitudinal axis of the scroll compressor is rectangular in shape.

9. The scroll compressor of claim 6, further comprising at least one intermediate pressure duct formed in the orbiting scroll, the intermediate pressure duct being in fluid communication with the intermediate pressure chamber.

10. A scroll compressor for a motor vehicle air conditioning system comprising:

a first housing including a high pressure chamber;

a stationary second housing including an outer surface;

a fixed scroll overlying and having engaging contact with the stationary second housing;

an orbiting scroll orbiting with respect to the fixed scroll, the fixed scroll and the orbiting scroll cooperating to compress a gas and the orbiting scroll including an outer surface facing the stationary second housing, the outer surface of the orbiting scroll defining an annularly extending groove formed therein;

an intermediate pressure chamber defined by the stationary second housing adjacent the orbiting scroll; and at least one sealing means extending from the outer surface of the stationary second housing to the outer surface of the orbiting scroll, the at least one sealing means including an annularly extending gasket and an annularly extending O-ring overlying the annularly extending gasket and having engaging contact therewith wherein the annularly extending gasket is positioned adjacent the stationary housing and has engaging contact therewith, wherein an entirety of the annularly extending O-ring is disposed in the annularly extending groove.

11. The scroll compressor of claim 10, wherein the annularly extending O-ring contacts at least one inner face of the orbiting scroll located within and adjacent the annularly extending groove.

12. The scroll compressor of claim 10, wherein a cross-section of the annularly extending gasket taken through a plane parallel to a longitudinal axis of the scroll compressor is rectangular in shape.

13. The scroll compressor of claim 10, further comprising at least one intermediate pressure duct formed in the orbiting scroll in fluid communication with the intermediate pressure chamber.

14. The scroll compressor of claim 10, wherein a cross-section of the annularly extending O-ring taken through a plane parallel to a longitudinal axis of the scroll compressor is circular in shape.

* * * * *